US005657688A

United States Patent [19]

Gardner et al.

[11] Patent Number: 5,657,688

[45] Date of Patent: Aug. 19, 1997

[54] SLOT MACHINE SHAPED CAN CRUSHERS

[76] Inventors: Paul Anthony Gardner; Doreen L. Gardner, both of 562 Mead La., Riviera, Ariz. 86442

[21] Appl. No.: 282,321

[22] Filed: Jul. 29, 1994

[51] Int. Cl.[6] ..... B30B 9/32; B30B 5/06

[52] U.S. Cl. ..... 100/152; 100/902

[58] Field of Search ..... 100/151, 152, 100/902; 194/208, 209; 273/138 R

[56] References Cited

U.S. PATENT DOCUMENTS

| | | | |
|---|---|---|---|
| 969,720 | 9/1910 | Pickett | 100/152 |
| 1,801,487 | 4/1931 | Cirignani | 100/152 |
| 2,282,708 | 5/1942 | Dantzig | 100/152 |
| 5,346,048 | 9/1994 | Wilhelm | 194/209 |
| 5,355,788 | 10/1994 | Phinney | 100/152 |
| 5,402,872 | 4/1995 | Clurman | 194/209 |

FOREIGN PATENT DOCUMENTS

| | | | |
|---|---|---|---|
| 0303137 | 2/1989 | European Pat. Off. | 100/902 |
| 5-318191 | 12/1993 | Japan | 100/902 |
| 2011302 | 7/1979 | United Kingdom | 100/902 |

*Primary Examiner*—Stephen F. Gerrity

[57] ABSTRACT

A slot machine shaped can crusher comprising: an outer case formed as a hollow rectangular shaped box with an open roof, the roof of the case including a large aperture and one sidewall including a circular aperture, the lower portion of the front wall extending frontwardly therefrom, the lower portion including a rectangular shaped hole with a generally rectangular shaped removable tray positioned therein; and an inner frame comprised of a horizontally positioned planar floor and two vertically positioned planar side brackets, a plurality of rollers being coupled between the brackets, one of the rollers including a plurality of symbol wheels positioned therearound, a plurality of rubber belts being positioned around at least two of the rollers, a plurality of drive cables being positioned around at least two of the rollers, a handle being operatively coupled to at least one of the rollers and adapted to cause rotational movement of the rollers when pulled by a user, the moving rollers causing an inserted can to be crushed therein, the inner frame adapted to be coupled within the outer case in the operative orientation.

2 Claims, 4 Drawing Sheets

SLOT MACHINE SHAPED CAN CRUSHERS

BACKGROUND OF THE INVENTION

1. Field of the Invention

The present invention relates to slot machine shaped can crushers and more particularly pertains to crushing cans into a generally planar configuration to facilitate storage and transport for recycling purposes.

2. Description of the Prior Art

The use of container crushing devices is known in the prior art. More specifically, container crushing devices heretofore devised and utilized for the purpose of crushing cans, bottles and other containers are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,092,234 to Von Rohr a rotating drum container crusher.

U.S. Pat. No. 5,025,995 to Smith discloses an apparatus and crushing disposable containers.

U.S. Pat. No. 4,995,314 to Buer discloses a can flattening machine.

U.S. Pat. No. 4,722,269 to Watkinson discloses a portable can crusher.

Lastly, U.S. Pat. No. 4,862,796 to Lodovico discloses an apparatus for crushing cans.

In this respect, the slot machine shaped can crushers according to the present invention substantially departs from the conventional concepts and designs of the prior art, and in doing so provides an apparatus primarily developed for the purpose of crushing cans into a generally planar configuration to facilitate storage and transport for recycling purposes.

Therefore, it can be appreciated that there exists a continuing need for new and improved slot machine shaped can crushers which can be used for crushing cans into a generally planar configuration to facilitate storage and transport for recycling purposes. In this regard, the present invention substantially fulfills this need.

SUMMARY OF THE INVENTION

In view of the foregoing disadvantages inherent in the known types of container crushing devices now present in the prior art, the present invention provides an improved slot machine shaped can crusher. As such, the general purpose of the present invention, which will be described subsequently in greater detail, is to provide a new and improved slot machine shaped can crusher and method which has all the advantages of the prior art and none of the disadvantages.

To attain this, the present invention essentially comprises a new and improved slot machine shaped can crusher comprising, in combination: an outer case formed as a hollow rectangular shaped box with a rear wall, a front wall, an open roof and open floor, the case having a first sidewall including a large circular aperture above its bottom edge, the lower half of the front wall extends frontwardly from the remainder of the front wall, the lower half includes a large rectangular shaped hole surrounded by a plurality of apertures, a rounded downwardly angled ledge being positioned between the upper and lower halves of the front wall, the ledge including an approximately centrally located rectangular shaped transparent plastic window, the case including a plurality of apertures near the top and bottom edges of each of its walls; a cover formed in a generally planar rectangular configuration and including a centrally located rectangular shaped aperture, the cover including two parallel triangular shaped guides extending downwardly from its lower surface adjacent to two opposing side edges of the apertures, the side edges of the cover including a plurality of screw bores, the cover adapted to be coupled horizontally within the open roof of the outer case with cooperatively coupled screws; a crushed can tray formed as a generally rectangular shaped hollow box, the tray having an open front wall with a thin ledge extending from its side edges, the ledge including a plurality of screw apertures positioned therearound, the roof of the tray being open from its midpoint to its rear wall, the tray adapted to be coupled within the rectangular aperture in the front region of the outer case with cooperatively coupled screws; an inner frame comprised of a horizontally positioned planar floor and two vertically positioned planar side brackets, the floor including a plurality of screw bores in its side edges, the two side brackets being positioned adjacent to opposing side edges of the floor, the brackets having a front section with a shorter height than the rear section with each including a circular aperture in its upper front corner, each side edge of each rear section including a semi circular shaped upwardly extending projection positioned adjacent thereto, the lower portion of each bracket including two circular apertures positioned between the projections, the frame adapted to be coupled to and positioned within the outer case in the operative orientation; five rollers formed in a generally cylindrical configuration, a thin first roller being coupled within the apertures in the front section of the brackets, the first roller including a groove positioned adjacent to the first side bracket and three symbol wheels positioned around its central region, the second and third rollers being coupled within the apertures in the frontward projections of the brackets, the fourth roller being coupled within the lower front apertures in each bracket and including two grooves positioned adjacent to the first side bracket, the fifth roller being coupled within the lower rear apertures and including a single groove and an axially positioned socket adjacent to the first side bracket, a first drive cable being affixed around the grooves of the first and fourth rollers in an oval configuration, a second drive cable being affixed around the grooves of the fourth and fifth rollers in a figure eight configuration; two heavy duty rubber belts being formed in a generally planar oval configuration, a first belt being affixed in a generally vertical orientation around the third and fifth rollers, a second belt being affixed in a generally vertical orientation around the second and fourth rollers; and a handle formed in a generally L-shaped configuration with the long end positioned vertically out side the case, the short end consisting of a generally cylindrical shaped one way free wheel clutch and positioned through the outer case and inside the socket in the fifth roller, the handle adapted to turn the fifth roller when pulled downward causing the other operatively coupled rollers to move, thereby crushing an inserted can therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved slot machine shaped can crushers which have all the advantages of the prior art container crushing devices and none of the disadvantages.

It is another object of the present invention to provide new and improved slot machine shaped can crushers which may be easily and efficiently manufactured and marketed.

It is further object of the present invention to provide new and improved slot machine shaped can crushers which are of durable and reliable constructions.

An even further object of the present invention is to provide new and improved slot machine shaped can crushers which are susceptible of a low cost of manufacture with regard to both materials and labor, and which accordingly are then susceptible of low prices of sale to the consuming public, thereby making such slot machine shaped can crushers economically available to the buying public.

Still yet another object of the present invention is to provide new and improved slot machine shaped can crushers which provide in the apparatuses and methods of the prior art some of the advantages thereof, while simultaneously overcoming some of the disadvantages normally associated therewith.

Still another object of the present invention is to crush cans into a generally planar configuration to facilitate storage and transport for recycling purposes.

Lastly, it is an object of the present invention to provide a new and improved slot machine shaped can crusher comprising: an outer case formed as a hollow rectangular shaped box with an open, the roof of the case including a large aperture and one sidewall including a circular aperture, the lower portion of the front wall extending frontwardly therefrom, the lower portion including a rectangular shaped hole with a generally rectangular shaped removable tray positioned therein; and an inner frame comprised of a horizontally positioned planar floor and two vertically positioned planar side brackets, a plurality of rollers being coupled between the brackets, one of he rollers including a plurality of symbol wheels positioned therearound, a plurality of rubber belts being positioned around at last two of the rollers, a plurality of drive cables being positioned around at least two of the rollers, a handle being operatively coupled to at least one of the rollers and adapted to cause rotational movement of the rollers when pulled by a user, the moving rollers causing an inserted can to be crushed therein, the inner frame adapted to be coupled within the outer case in the operative orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
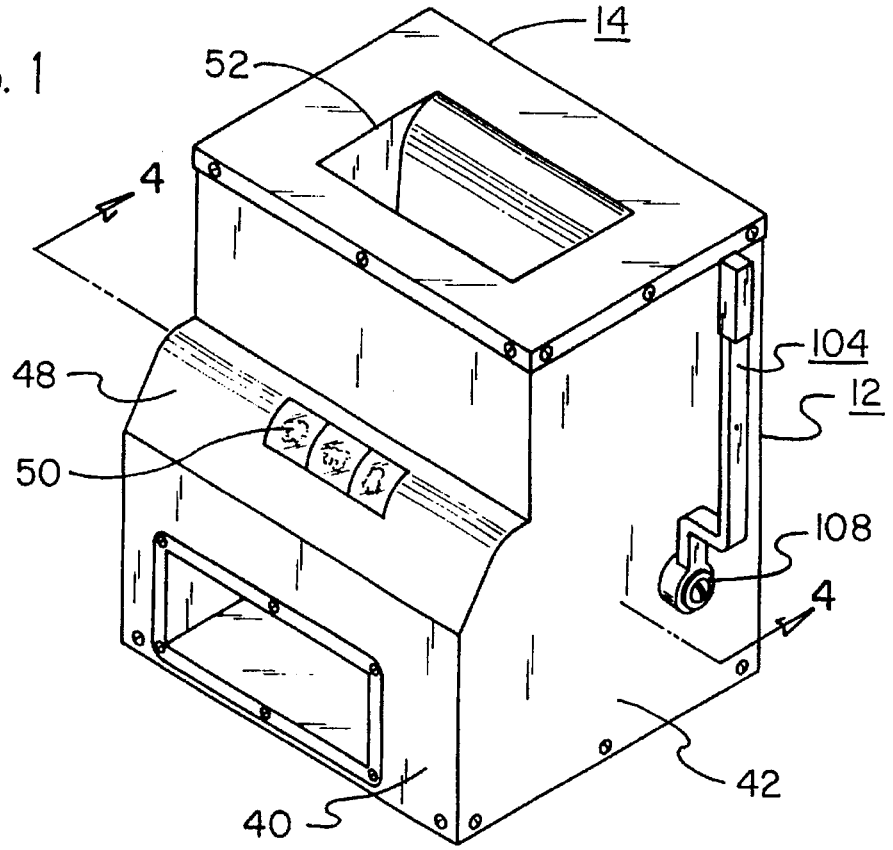
FIG. 1 is a perspective view of the preferred embodiment of the slot machine shaped can crushers constructed in accordance with the principles of the present invention.

With reference now to the drawings, and in particular to FIG. 1 thereof, the preferred embodiment of the new and improved slot machine shaped can crushers embodying the principles and concepts of the present invention and generally designated by the reference numeral 10 will be described.

The present invention, the new and improved slot machine shaped can crusher is comprised of a plurality of components. Such components in their broadest context include an outer case 12, a cover 14, a crushed can tray 16, an inner frame 18, five rollers 20, 22, 24, 26, 28, two heavy duty rubber belts 30, 32 and a handle 34.

Figure 6:
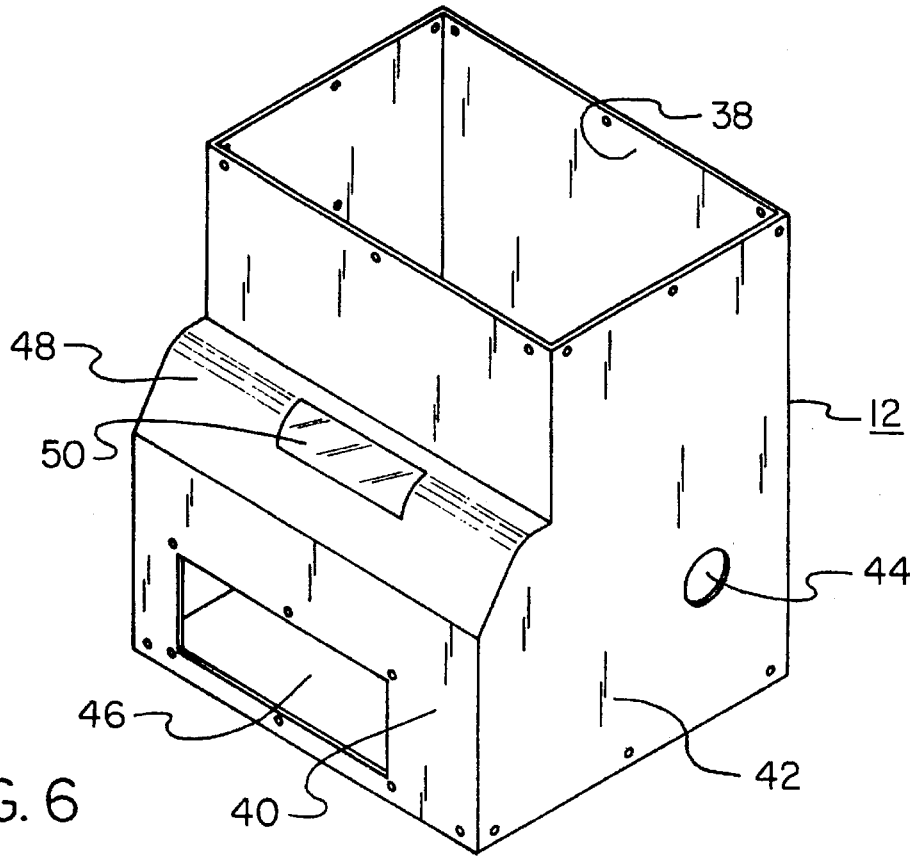
FIG. 6 is a perspective view of the outer case of the apparatus.

More specifically, the outer case 12 is formed as a hollow rectangular shaped box with a rear wall 38, a front wall 40, an open roof and an open floor. The case has a first sidewall 42 which includes a large circular aperture 44 above its bottom edge. The case is fabricated of sturdy molded plastic. The lower half of the front wall extends frontwardly from the remainder of the front wall. The lower half includes a large rectangular shaped hole 46 surrounded by a plurality of apertures. Note FIG. 6.

A rounded, downwardly angled ledge 48 is positioned between the upper and lower halves of the front wall. The ledge includes an approximately centrally located rectangular shaped transparent plastic window 50. After the handle of the apparatus is pulled by the user the resulting symbols are viewed through the plastic window. The case includes a plurality of apertures near the top and bottom edges of each of its walls. Note FIG. 6.

Figure 7:
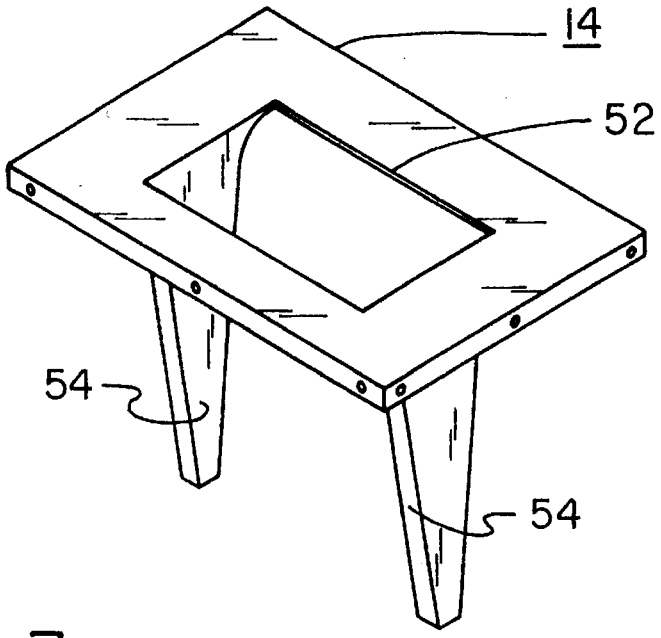
FIG. 7 is a perspective view of the top cover of the apparatus.

A cover 14 is formed in a generally planar rectangular configuration and includes a centrally located rectangular shaped aperture 52. The cover also includes two parallel triangular shaped guides 54 which extend downwardly from its lower surface adjacent to two opposing side edges of the apertures. The apex of the guides includes a flat edge at its furthest extent. The side edges of the cover include a plurality of screw bores. The cover is adapted to be coupled horizontally within the open roof of the outer case with cooperatively coupled screws. When operating the apparatus the user drops cans through the aperture in the cover. The guides insure that the inserted cans are properly positioned within the apparatus. Note FIGS. 1 and 7.

Figure 8:
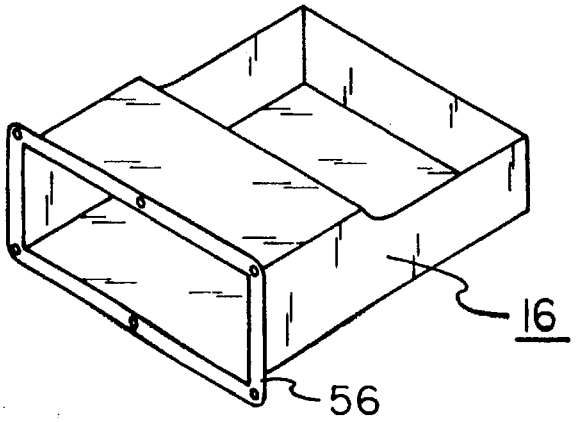
FIG. 8 is a perspective view of the crushed can tray of the apparatus.

A crushed can tray 16 is formed as a generally rectangular shaped hollow box. The tray has an open front wall with a thin ledge 56 extending from its side edges. The ledge includes a plurality of screw apertures positioned thereabout. The roof of the tray is open from its midpoint to its rear wall. The tray is adapted to be coupled within the rectangular aperture in the front region of the outer case with cooperatively coupled screws. The flattened cans are deposited directly into the tray. The tray is easily removable when emptying is required. Note FIGS. 1 and 8.

Figure 2:
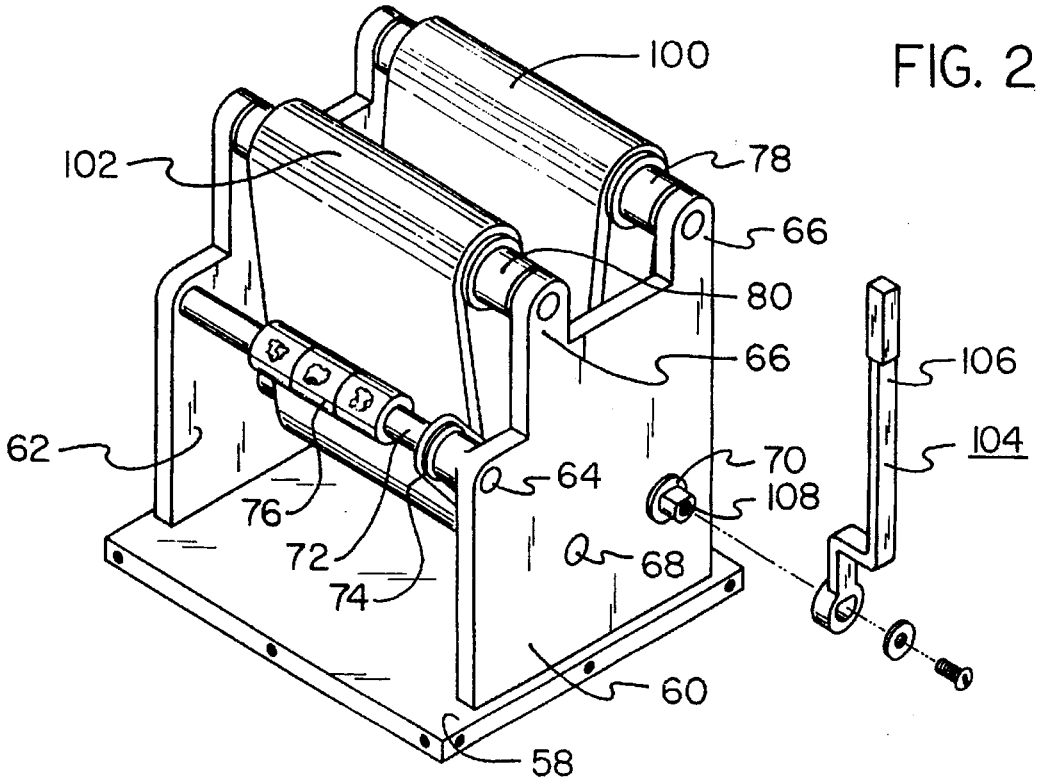
FIG. 2 is a perspective view of the apparatus with the outer case removed illustrating the inner frame.

An inner frame 18 is comprised of a horizontally positioned planar floor 58 and two vertically positioned planar side brackets 60, 62. The floor includes a plurality of screw bores in its side edges. The two side brackets are positioned adjacent to opposing side edges of the floor. The brackets have a front section with a shorter height than the rear section, with the front section of each bracket including a circular aperture 64 in its upper front corner. The front section is positioned within the frontwardly projecting portion of the front wall of the outer case in the operative orientation. Note FIGS. 1 and 2.

Each side edge of each rear section includes a semi circular shaped, upwardly extending projection 66 positioned adjacent thereto. The lower portion of each bracket includes two circular apertures 68, 70 positioned between the projections. The frame is adapted to be coupled to, and positioned within the outer case in the operative orientation. A plurality of screws couple the outer case to the floor of the inner frame. Note FIGS. 1, 2 and 6.

Five rollers are formed in a generally cylindrical configuration. A thin first roller 72 is coupled within the apertures in the front section of the brackets. The first roller includes a groove 74 positioned adjacent to the first side bracket and three symbol wheels 76 positioned around its central region. The first roller and symbol wheels spin when the handle is pulled, simulating the action of a casino slot machine. The second 78 and third 80 rollers are coupled within the apertures in the frontward projections of the brackets. The second and third rollers are positioned near the uppermost extent of the apparatus and are adapted to securely retain the rubber belts which are positioned therearound. Note FIG. 2.

Figure 3:
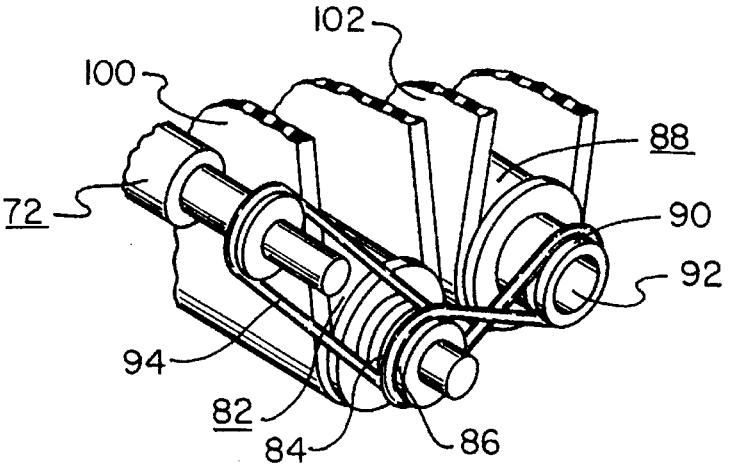
FIG. 3 is a broken away perspective view of the first, fourth and fifth rollers of the apparatus.

The fourth roller 82 is coupled within the lower front apertures 68 in each bracket, and include two grooves 84, 86 which are positioned adjacent to the first side bracket. The fifth roller 88 is coupled within the lower rear apertures 70. The fifth roller includes a single groove 90 and an axially positioned socket 92. The groove and socket are positioned adjacent to the first side bracket. The fourth and fifth rollers are positioned near the lowermost extent of the apparatus and are the principle rollers involved in the actual crushing of the cans. Note FIGS. 2 and 3.

A first drive cable 94 is affixed around the grooves 74, 84 of the first and fourth rollers in an oval configuration. A second drive cable 96 is affixed around the grooves 86, 90 of the fourth and fifth rollers in a figure eight configuration. The figure eight configuration causes the drive wheels to move in opposite directions thereby effecting rotational crushing of inserted cans. Note FIG. 3.

Two heavy duty rubber belts 100, 102 are formed in a generally planar oval configuration. A first belt 100 is affixed in a generally vertical orientation around the third 78 and fifth 88 rollers. A second belt 102 is affixed in a generally vertical orientation around the second 80 and fourth 82 rollers. Inserted cans are positioned between the belts and are crushed at the lowermost extent of the belts between the rollers. Note FIGS. 2 and 3.

Figure 4:
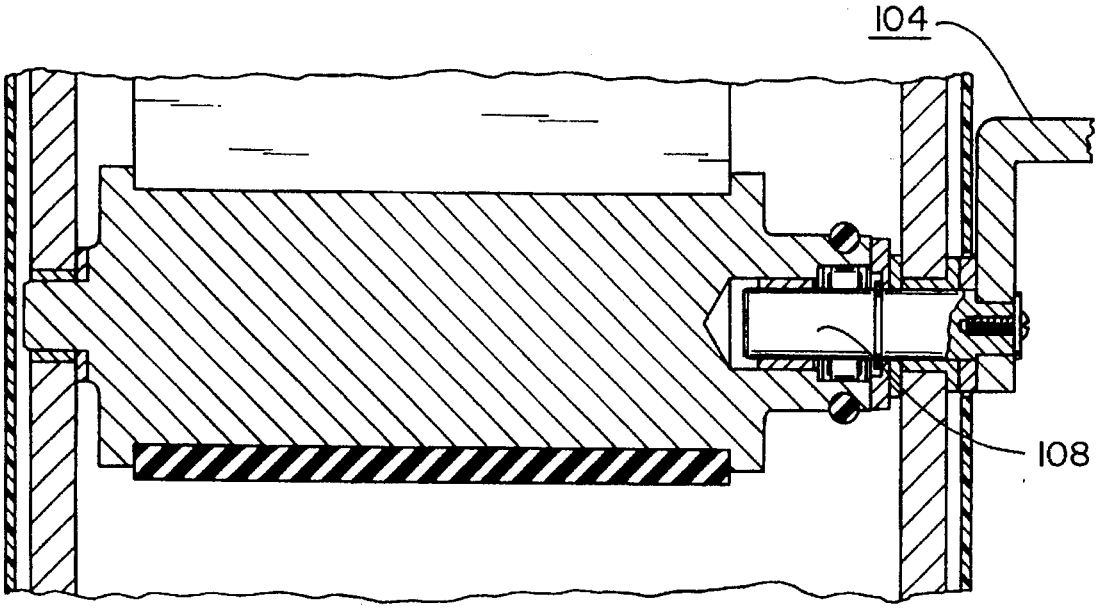
FIG. 4 is a broken away cross sectional view of the handle and fifth roller of the apparatus.
Figure 5:
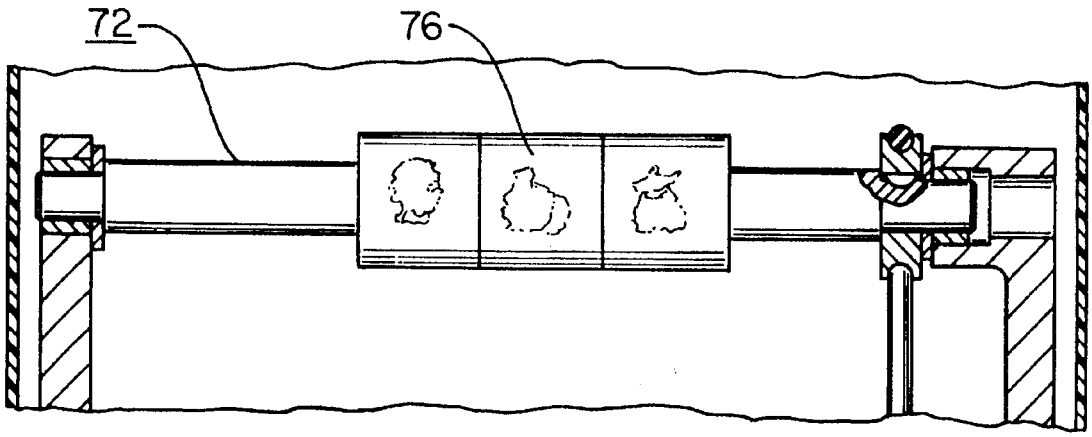
FIG. 5 is a broken away perspective view of the first roller of the apparatus illustrating the symbol wheels.

A handle 104 is formed in a generally L-shaped configuration with the long end 106 positioned vertically and outside of the case. The short end 108 consists of a generally cylindrical shaped one way free wheel clutch and is positioned through the outer case and inside the socket in the fifth roller. Note FIG. 4. The handle is adapted to turn the fifth roller when pulled downward causing the other operatively coupled rollers to move, thereby crushing an inserted can therebetween. Note FIGS. 2, 3 and 4. When the handle is pulled the fourth and fifth rollers move in opposite directions causing the belts to move in opposite directions thereby forcing inserted cans downward to be crushed. The crushed cans are then automatically deposited into the crushed can tray. Note FIGS. 2 and 8.

The slot machine shaped can crusher is ideal for anyone who recycles cans. The outer casing is fabricated of molded plastic shaped in the configuration of a slot machine. The apparatus is operated by simply inserting an empty can into the aperture in the roof and pulling the handle. The crushed cans can then be easily stored and transported. Alternative embodiments of the apparatus may also be manufactured. For instance, a multitude of different outer casings could be produced to suit the tastes of different users. Additionally, the rubber belts could be replaced with metal chains for the purpose of recycling glass or plastic.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A slot machine shaped can crusher comprising, in combination:

an outer case formed as a hollow rectangular shaped box with a rear wall, a front wall, an open roof and open floor, the case having a first sidewall including a large circular aperture above its bottom edge, the lower half of the front wall extends frontwardly from the remainder of the front wall, the lower half includes a large rectangular shaped hole surrounded by a plurality of apertures, a rounded downwardly angled ledge being positioned between the upper and lower halves of the front wall, the ledge including an approximately centrally located rectangular shaped transparent plastic window, the case including a plurality of apertures near the top and bottom edges of each of its walls;

a cover formed in a generally planar rectangular configuration and including a centrally located rectangular shaped aperture, the cover including two parallel triangular shaped guides extending downwardly from its lower surface adjacent to two opposing side edges of the apertures, the side edges of the cover including a plurality of screw bores, the cover adapted to be coupled horizontally within the open roof of the outer case with cooperatively coupled screws;

a crushed can tray formed as a generally rectangular shaped hollow box, the tray having an open front wall with a thin ledge extending from its side edges, the ledge including a plurality of screw apertures positioned therearound, the roof of the tray being open from its midpoint to its rear wall, the tray adapted to be coupled within the rectangular aperture in the front region of the outer case with cooperatively coupled screws;

an inner frame comprised of a horizontally positioned planar floor and two vertically positioned planar side brackets, the floor including a plurality of screw bores in its side edges, the two side brackets being positioned adjacent to opposing side edges of the floor, the brackets having a front section with a shorter height than the rear section with each including a circular aperture in its upper front corner, each side edge of each rear section including a semi circular shaped upwardly extending projection positioned adjacent thereto, the lower portion of each bracket including two circular apertures positioned between the projections, the frame adapted to be coupled to and positioned within the outer case in the operative orientation;

five rollers formed in a generally cylindrical configuration, a thin first roller being coupled within the apertures in the front section of the brackets, the first roller including a groove positioned adjacent to the first side bracket and three symbol wheels positioned around its central region, the second and third rollers being coupled within the apertures in the frontward projections of the brackets, the fourth roller being coupled within the lower front apertures in each bracket and including two grooves positioned adjacent to the first side bracket, the fifth roller being coupled within the lower rear apertures and including a single groove and an axially positioned socket adjacent to the first side bracket, a first drive cable being affixed around the grooves of the first and fourth rollers in an oval configuration, a second drive cable being affixed around the grooves of the fourth and fifth rollers in a figure eight configuration;

two heavy duty rubber belts being formed in a generally planar oval configuration, a first belt being affixed in a generally vertical orientation around the third and fifth rollers, a second belt being affixed in a generally vertical orientation around the second and fourth rollers; and a handle formed in a generally L-shaped configuration with the long end positioned vertically outside the case, the short end consisting of a generally cylindrical shaped one way free wheel clutch and positioned through the outer case and inside the socket in the fifth roller, the handle adapted to turn the fifth roller when pulled downward causing the other operatively coupled rollers to move, thereby crushing an inserted can between the belts and rollers.

2. A slot machine shaped can crusher comprising:

an outer case formed as a hollow rectangular shaped box with a roof, the roof of the case including a large aperture and one sidewall including a circular aperture, the lower portion of the front wall extending frontwardly therefrom, the lower portion including a rectangular shaped hole with a generally rectangular shaped removable tray positioned therein; and an inner frame comprised of a horizontally positioned planar floor and two vertically positioned planar side brackets, a plurality of rollers being coupled between the brackets, one of he rollers including a plurality of symbol wheels positioned therearound, a plurality of rubber belts being positioned around at least two of the rollers, a plurality of drive cables being positioned around at least two of the rollers, a handle being operatively coupled to at least one of the rollers and adapted to cause rotational movement of the rollers when pulled by a user, the moving rollers causing an inserted can to be crushed therein, the inner frame adapted to be coupled within the outer case in the operative orientation.

* * * * *